US008365750B2

(12) United States Patent
Zhou

(10) Patent No.: US 8,365,750 B2
(45) Date of Patent: Feb. 5, 2013

(54) QUICK-RELEASE STRUCTURE FOR FRAME ROD OF TENT

(75) Inventor: Nanqing Zhou, Xiamen (CN)
(73) Assignee: Q-Yield Outdoor Gear Ltd., Xiamen, Fujian (CN)

( * ) Notice: Subject to any disclaimer, the term of this patent is extended or adjusted under 35 U.S.C. 154(b) by 0 days.

(21) Appl. No.: 13/499,700

(22) PCT Filed: Sep. 13, 2010

(86) PCT No.: PCT/CN2010/076841
§ 371 (c)(1), (2), (4) Date: Apr. 1, 2012

(87) PCT Pub. No.: WO2012/034266
PCT Pub. Date: Mar. 22, 2012

(65) Prior Publication Data
US 2012/0192907 A1 Aug. 2, 2012

(51) Int. Cl.
*E04H 15/60* (2006.01)

(52) U.S. Cl. ..... 135/114; 135/135; 135/146; 135/159

(58) Field of Classification Search ..... 135/114, 135/120.3, 130, 135, 146, 159; 403/100, 403/102, 92, 166, 408.1, 53, 55, 62, 83, 84, 403/93, 94, 96
See application file for complete search history.

(56) References Cited

U.S. PATENT DOCUMENTS

| | | | | | |
|---|---|---|---|---|---|
| 2,135,487 | A * | 11/1938 | Askue | 403/53 |
| 3,181,542 | A * | 5/1965 | Bareis | 135/98 |
| 3,879,146 | A * | 4/1975 | Mayer | 403/93 |
| 4,063,830 | A * | 12/1977 | Ban | 403/3 |
| 4,074,682 | A * | 2/1978 | Yoon | 135/135 |
| 4,121,605 | A * | 10/1978 | Schmerl | 135/65 |
| 6,776,179 | B1 * | 8/2004 | Chen | 135/147 |
| 8,205,627 | B2 * | 6/2012 | Zhou | 135/114 |

* cited by examiner

*Primary Examiner* — Noah Chandler Hawk

(57) ABSTRACT

A quick-release structure for a frame rod of a tent includes an upper rod, a middle rod, a lower rod, an upper joint, a lower joint and a quick-release assembly. The upper joint includes a first joint head and a second upper joint head. The first upper joint head is connected to the upper rod, and the second upper joint head is connected to the middle rod. The first upper joint head includes an eccentric cam. The lower joint includes a first lower joint head and second lower joint heads. The first lower joint head is connected to the middle rod, and the second lower joint head is connected to the lower rod. The quick-release assembly includes a pipe, a pulley, a pulley seat, an upper pin, an upper spring, a lower pin and a lower spring.

4 Claims, 5 Drawing Sheets

QUICK-RELEASE STRUCTURE FOR FRAME ROD OF TENT

BACKGROUND OF THE INVENTION

1. Field of the Invention

The present invention relates to a tent, and more particularly to a quick-release structure for a frame rod of a tent.

2. Description of the Prior Art

A large-sized tent comprises a canopy and a support frame to support the canopy. The support frame comprises a plurality of poles pivotally connected to and a top connection member. In order to collapse the tent conveniently and to reduce the size to of tent after collapsed, each pole comprises a small pipe, a large pipe and a positioning structure. The large pipe is fitted on the small pipe with the positioning structure to position the large pipe and the small pipe after they are expanded. Alternatively, the pole comprises a plurality of rods which are pivotally connected with each other. A connection member is provided at the joint of two adjacent rods. The is connection member comprises a fixing structure to fix the two rods when they are expanded. No matter what pole is adopted, each joint must be operated separately when the tent is collapsed or expanded. This is very inconvenient. Accordingly, the inventor of the present invention has devoted himself based on his many years of practical experiences to solve this problem.

SUMMARY OF THE INVENTION

The primary object of the present invention is to provide a quick-release structure for a frame rod of a tent, which can support the tent steady and collapse the tent quickly.

In order to achieve the aforesaid object, the present invention provides a quick-release structure of a tent frame, which comprises an upper rod, a middle rod, a lower rod, an upper joint, a lower joint and a quick-release assembly. The upper joint is disposed between the upper rod and the middle rod. The upper joint comprises a first upper joint head and a second upper joint head. The first upper joint head is connected to the upper rod, and the second upper joint head is connected to the middle rod. The first upper joint head comprises an eccentric cam. The lower joint is disposed between the middle rod and the lower rod. The lower joint comprises a first lower joint head and a second lower joint head. The first lower joint head is connected to the middle rod, and the second lower joint head is connected to the lower rod. The quick-release assembly comprises a rigid pipe, a pulley, a pulley seat, an upper pin, an upper spring, a lower pin and a lower spring. The pipe is inserted in the middle rod. The pulley incorporated with the pulley seat is disposed at an upper end of the pipe and corresponds to the first upper joint head. The upper pin incorporated with the upper spring is disposed at a lower end of the pipe. The lower pin incorporated with the lower spring is disposed in the lower rod. A portion of the lower pin is protruded out of the second lower joint head.

Preferably, the second upper joint head has a trough to receive the pulley and the pulley seat.

Preferably, the first lower joint head has a trough to receive the upper pin and the upper spring.

Preferably, the second lower joint head has a trough to receive the lower pin and the lower spring.

To collapse the tent frame, the top of the tent frame is pushed downward to bring the first upper joint head connected to the upper rod to turn downward. The eccentric cam of the first upper joint head pushes the pulley at the upper end of the pipe, so that the pulley and the pipe are moved downward. The upper pin at the lower end of the pipe compresses the upper spring downward to push the lower pin out of the trough of the first lower joint head connected to the middle rod, so that the second lower joint head is disengaged from the first lower joint head and the lower rod can be folded quickly.

DETAILED DESCRIPTION OF THE PREFERRED EMBODIMENTS

Embodiments of the present invention will now be described, by way of example only, with reference to the accompanying drawings.

Figure 1:
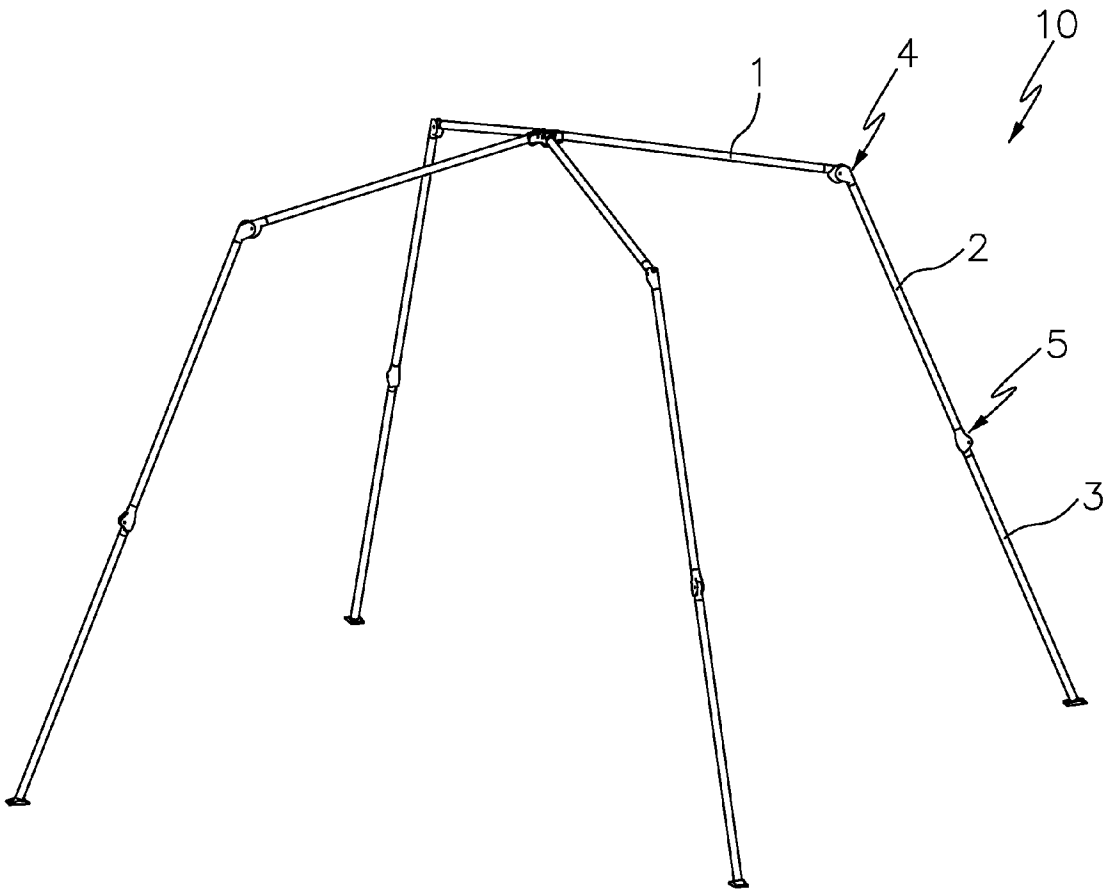
FIG. 1 is a perspective view of the present invention.
Figure 2:
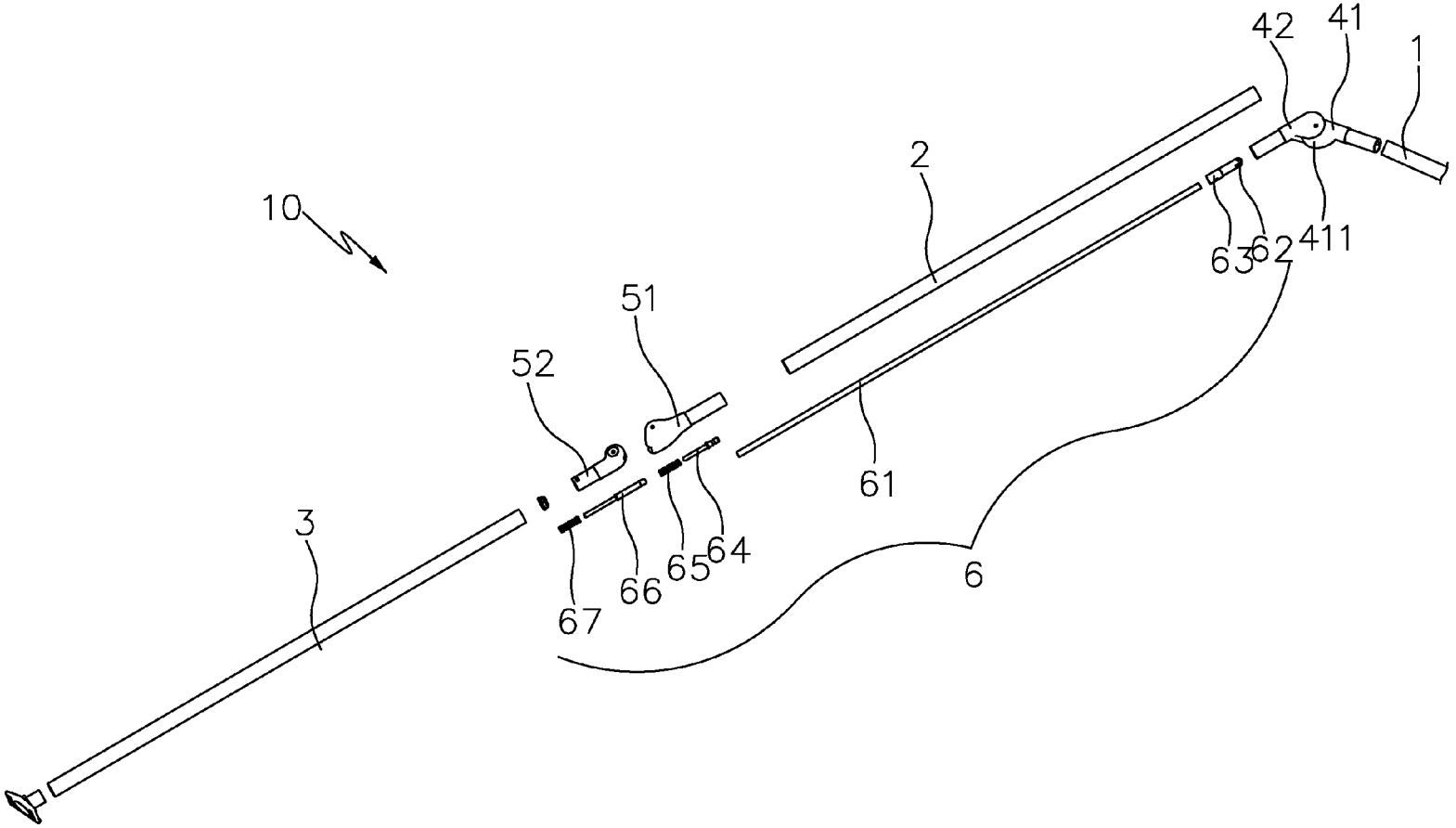
FIG. 2 is an exploded view of the present invention.

As shown in FIG. 1 and FIG. 2, a tent support frame comprises a plurality of poles 10. Each pole 10 comprises an upper rod 1, a middle rod 2, a lower rod 3, an upper joint 4, a lower joint 5 and a quick-release assembly 6.

The upper joint 4 is disposed between the upper rod 1 and the middle rod 2. The upper joint 4 comprises a first upper joint head 41 and a second upper joint head 42. The first upper joint head 41 is connected to the upper rod 1, and the second upper joint head 42 is connected to the middle rod 2. The first and second upper joint heads 41, 42 are pivotally connected together. Preferably, the first upper joint head 41 comprises an eccentric cam 411, and the second upper joint head 42 has a trough 421.

The lower joint 5 is disposed between the middle rod 2 and the lower rod 3. The lower joint 5 comprises a first lower joint head 51 and a second lower joint head 52. The first lower joint head 51 is connected to the middle rod 2, and the second lower joint head 52 is connected to the lower rod 3. The first and second lower joint heads 51, 52 are pivotally connected together. Preferably, the first lower joint head 51 has a trough 511, and the second lower joint head 52 also has a trough 521.

The quick-release assembly 6 comprises a rigid pipe 61, a pulley 62, a pulley seat 63, an upper pin 64, an upper spring 65, a lower pin 66 and a lower spring 67. The pipe 61 may be made of aluminum or glassy steel and is inserted in the middle rod 2. The pulley 62 incorporated with the pulley seat 63 is disposed at an upper end of the pipe 61 and located in the trough 421 of the second upper joint head 42, corresponding to the first upper joint head 41. The upper pin 64 incorporated with the upper spring 65 is disposed at a lower end of the pipe 61 and located in the trough 511 of the first lower joint head 51. The lower pin 66 incorporated with the lower spring 67 is disposed in the lower rod 3 and inserted through the trough 521 of the second lower joint head 52. A portion of the lower pin 66 is protruded out of the second lower joint head 52.

To expand the present invention, the top of the tent frame is pulled upward to bring the first upper joint head 41 connected to the upper rod 1 to turn upward. The lower rod 3 and the middle rod 2 are expanded. The lower pin 66 in the lower rod 3 is biased by the lower spring 67 to protrude out of the trough 521 of the second lower joint head 52. The protruded portion of the lower pin 66 enters the trough 511 of the first lower joint head 51 connected to the middle rod 2 to engage with the upper pin 64, so that the first lower joint head 51 and the second lower joint head 52 are locked to support the expanded support frame steady.

Figure 3:
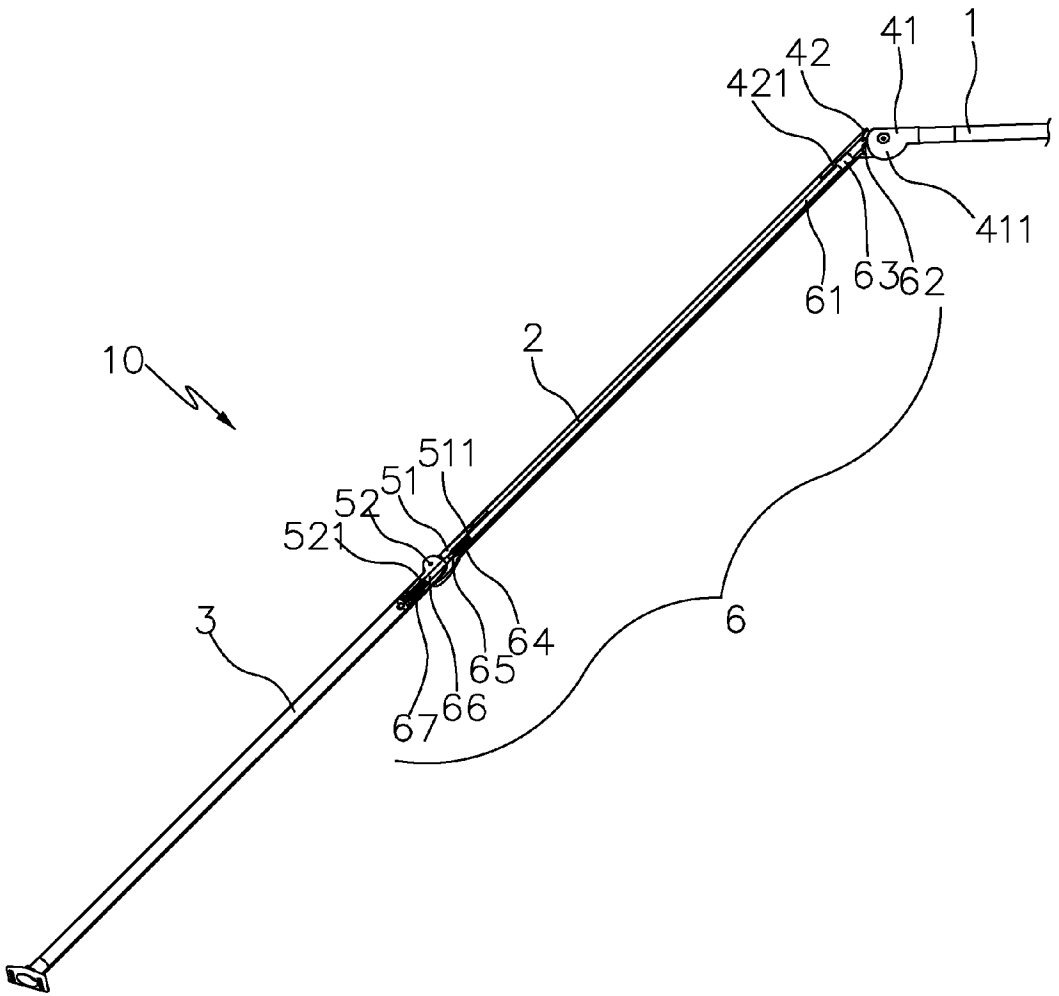
FIG. 3, FIG. 3A and FIG. 3B are schematic views showing the operation of the present invention.
Figure 3B:
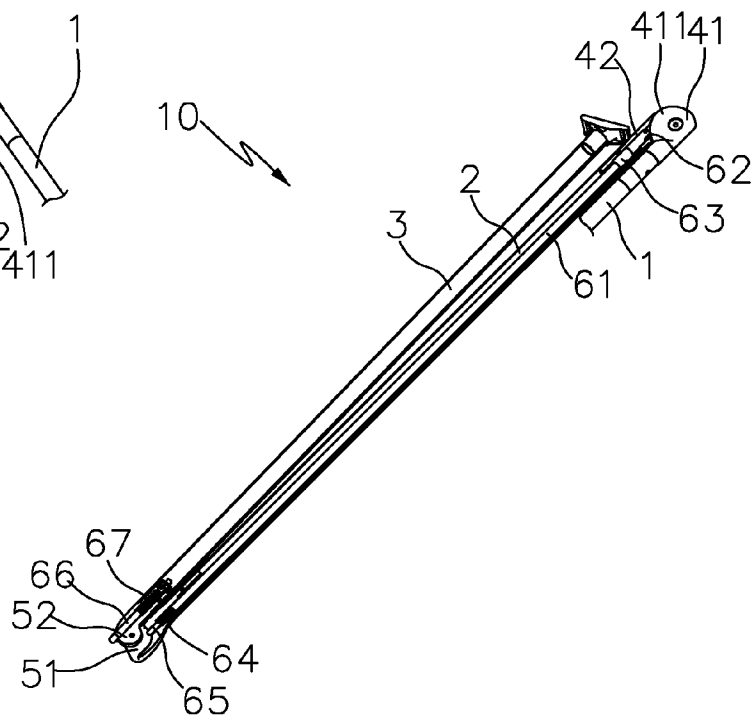
Figure 3A:
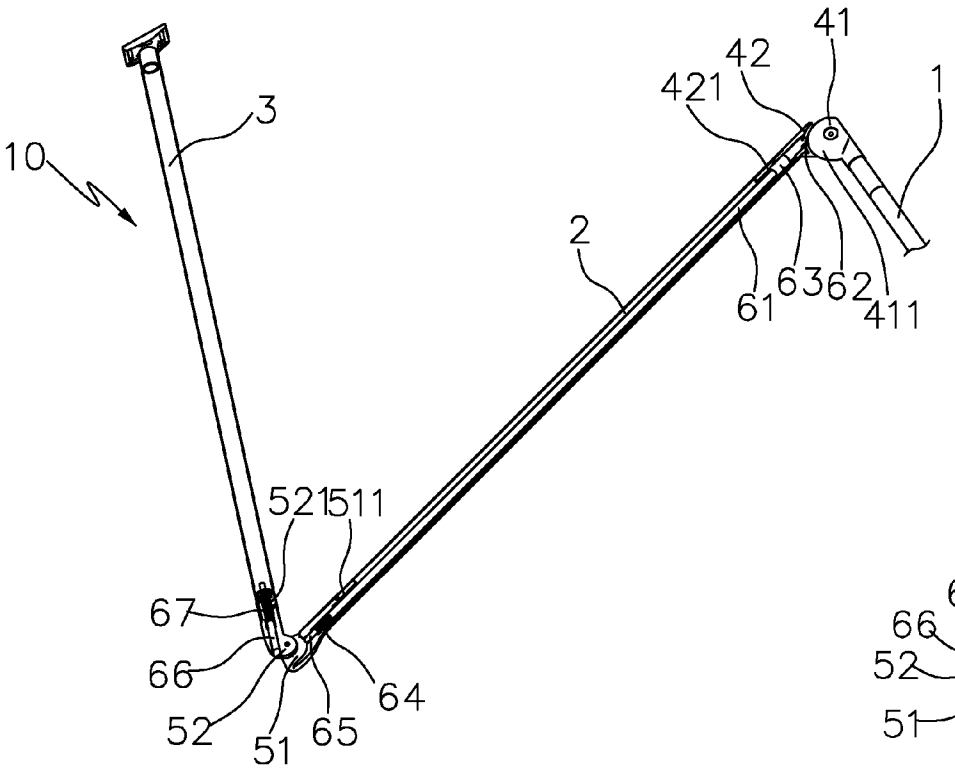
Figure 4:
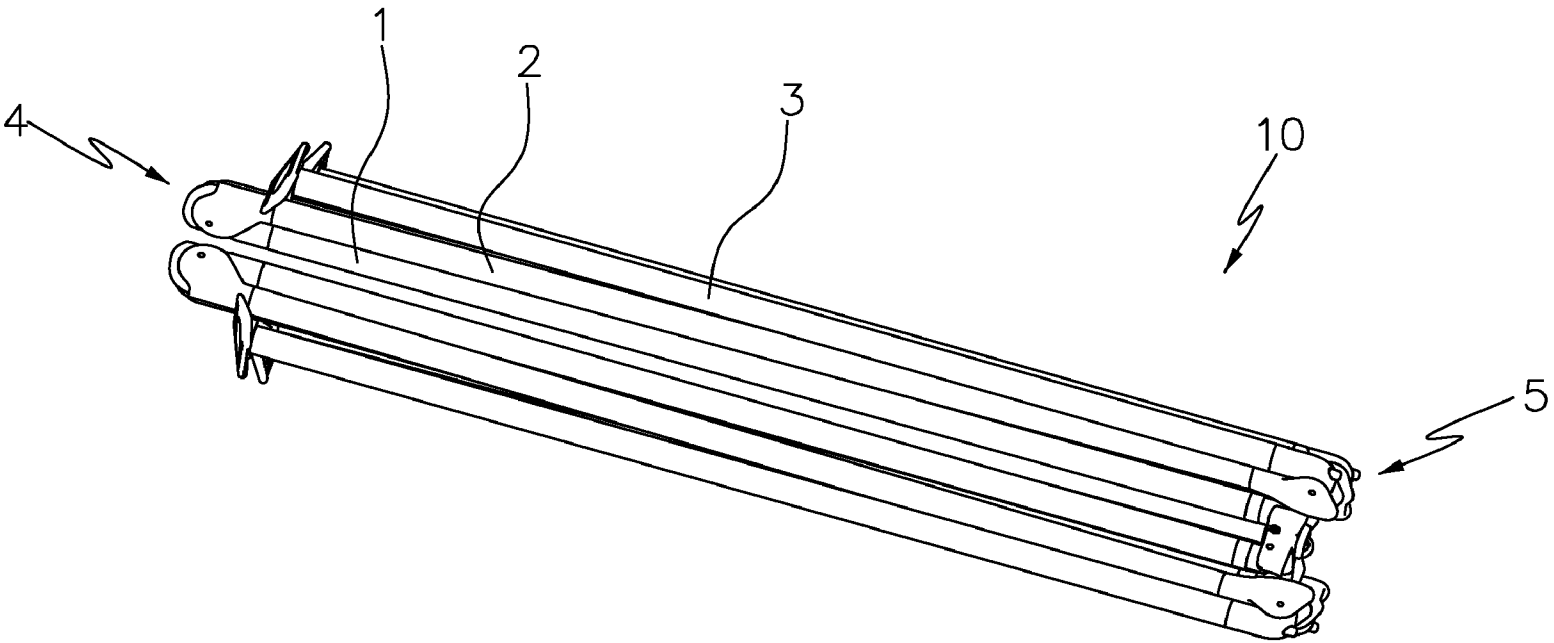
FIG. 4 is a schematic view of the present invention in a folded status.

As shown in FIG. 3, FIG. 3A and FIG. 3B, when the tent frame is collapsed, the top of the tent frame is pushed downward to bring the first upper joint head 41 connected to the upper rod 1 to turn downward. The eccentric cam 411 of the first upper joint head 41 pushes the pulley 62 at the upper end of the pipe 61, so that the pulley 62 and the pipe 61 are moved downward. The upper pin 64 at the lower end of the pipe 61 compresses the upper spring 65 downward to push the lower pin 66 out of the trough 511 of the first lower joint head 51 connected to the middle rod 2, so that the second lower joint head 52 is disengaged from the first lower joint head 51 and the lower rod 3 can be folded, as shown in FIG. 4.

Accordingly, the tent frame can be collapsed quickly and conveniently by pulling the top of the tent frame to disengage the upper rod 1, the middle rod 2 and the lower rod 3 from each other. Compared to the prior art, the operation of the present invention is simply, quick and convenient.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A quick-release structure for a frame rod of a tent, comprising an upper rod, a middle rod, a lower rod, an upper joint, a lower joint and a quick-release assembly, the upper joint being disposed between the upper rod and the middle rod, the upper joint comprising a first upper joint head and a second upper joint head, the first upper joint head being connected to the upper rod, the second upper joint head being connected to the middle rod, the first upper joint head comprising an eccentric cam;

the lower joint being disposed between the middle rod and the lower rod, the lower joint comprising a first lower joint head and a second lower joint head, the first lower joint head being connected to the middle rod, the second lower joint head being connected to the lower rod;

the quick-release assembly comprising a rigid pipe, a pulley, a pulley seat, an upper pin, an upper spring, a lower pin and a lower spring, the pipe being inserted in the middle rod, the pulley incorporated with the pulley seat being disposed at an upper is end of the pipe and corresponding to the first upper joint head, the upper pin incorporated with the upper spring being disposed at a lower end of the pipe, the lower pin incorporated with the lower spring being disposed in the lower rod, a portion of the lower pin being protruded out of the second lower joint head.

2. The quick-release structure as claimed in claim 1, wherein the second upper joint head has a trough to receive the pulley and the pulley seat.

3. The quick-release structure as claimed in claim 1, wherein the first lower joint head has a trough to receive the upper pin and the upper spring.

4. The quick-release structure as claimed in claim 1, wherein the second lower joint head has a trough to receive the lower pin and the lower spring.

* * * * *